US005816468A

United States Patent [19]

Yang

[11] Patent Number: 5,816,468

[45] Date of Patent: Oct. 6, 1998

[54] NO-IDLE-STRIKING STRUCTURE FOR NAILING MACHINES

[75] Inventor: Brad Yang, Taichung Hsien, Taiwan

[73] Assignee: Testo Industries Corp., Taipei, Taiwan

[21] Appl. No.: 880,292

[22] Filed: Jun. 24, 1997

[51] Int. Cl.[6] ..... B25C 1/04

[52] U.S. Cl. ..... 227/8; 227/120

[58] Field of Search ..... 227/8, 130, 120, 227/156

[56] References Cited

U.S. PATENT DOCUMENTS

| | | | |
|---|---|---|---|
| 4,597,517 | 7/1986 | Wagdy | 227/8 |
| 4,821,937 | 4/1989 | Rafferty | 227/8 |
| 5,180,091 | 1/1993 | Ota | 227/8 |
| 5,485,946 | 1/1996 | Jankel | 227/8 |
| 5,593,079 | 1/1997 | Mukoyama et al. | 227/8 |

*Primary Examiner*—Scott A. Smith
*Attorney, Agent, or Firm*—Donald C. Casey, Esq.

[57] ABSTRACT

A no-idle-striking structure for nailing machines including a strike assembly, a bumper bar, a magazine, and a follow plate. The bumper bar is provided with a hook which may extend into a magazine support. The follow plate has a stop portion. When there are nails in the magazine, the bumper bar is in normal state so that pulling of the trigger will cause a nail to be driven into a workpiece. But when the nails are used up, the follow plate will elevate to the position of the magazine support so that its stop portion will restrain the hook of the bumper bar from displacing rearwardly. As a result, pulling of the trigger will not effect any striking.

1 Claim, 7 Drawing Sheets

NO-IDLE-STRIKING STRUCTURE FOR NAILING MACHINES

BACKGROUND OF THE INVENTION (a) Field of the Invention

The present invention relates generally to a nailing machines, and more particularly to a no-idle-striking structure for pneumatic nailing machines.

(b) Description of the Prior Art

In conventional pneumatic nailing machines, compressed air is used as power to instantly push a strike pin so that the strike pin may smoothly strike a nail into a workpiece. the direction of compressed air flow in the air passage is controlled by a trigger and a bumper bar. When the trigger is pulled and the bumper bar is pressed, an internal trigger plate inside the trigger may urge against a valve switch so that the strike pin strikes. If only the trigger is pulled or the bumper bar is pressed, then the internal trigger plate cannot be driven to urge against an air valve lever to cause it to displace. However, once the nails in the magazine has been used up, then there will be idle striking. Since the load of the nails has been removed, the force of the compressed air for pushing the piston will be completely absorbed by the piston, cylinder and bottom buffer, which may easily lead to breaking of the piston or the bottom buffer. Therefore, there has been developed a no-idle-striking structure when there are no nails in the nailing machine. The structure is shown in FIGS. 1A and 1B. A hook 11 is provided in a trigger 10, and an outer side of the hook 11 has a trigger bar 12 welded thereto for extension into a nail channel 20. The trigger bar 12 is provided with a groove 121. A retaining plate 22 in the nail channel 20 is disposed on a follow plate 21 and has a flange 221 for engaging the groove 121. When there are still nails in the nail channel 20, pulling of the trigger 10 will cause the hook 11 to be drawn rearwardly thereby so that the trigger bar 12 in the nail channel 20 pulls rearwardly. When there are no more nails in the nail channel 20, the retaining plate 22 will elevate until its flange 221 is positioned in the groove 121 of the trigger bar 12. At this time, pulling of the trigger 10 will not affect the trigger bar 12 since its groove 121 is engaged by the flange 221 of the retaining plate 22. As a result, the hook 11 hooks the trigger 10 so that the latter cannot be pressed down and striking cannot take place. However, such a no-idle-striking structure requires a hook and a trigger bar in addition to the bumper bar, and a retaining plate has to be formed on the follow plate. This not only increases production costs but also poses difficulty in assembly. Besides, since the trigger bar is welded to the hook, the connection may not be satisfactory and reliable.

SUMMARY OF THE INVENTION

Accordingly, a primary object of the present invention is to provide a no-idle-striking structure for pneumatic nailing machines, which is simple to assembly so as to reduce production costs and labor; besides, the structure is reliable and strong and may avoid possible damage to the cylinder, piston and strike pin of the nailing machine.

In order to achieve the above-mentioned object, the no-idle-striking structure of the present invention essentially comprises a bumper bar and a follow plate in which the bumper bar is provided with a hook and the follow plate is provided with a stop portion. When there are nails in the magazine, striking may be effected when the trigger is pulled. But when there n nails in the magazine, the follow plate will elevate to a position where the stop portion will restrain the rearward displacement to the hook so that no striking may be effected.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1A:
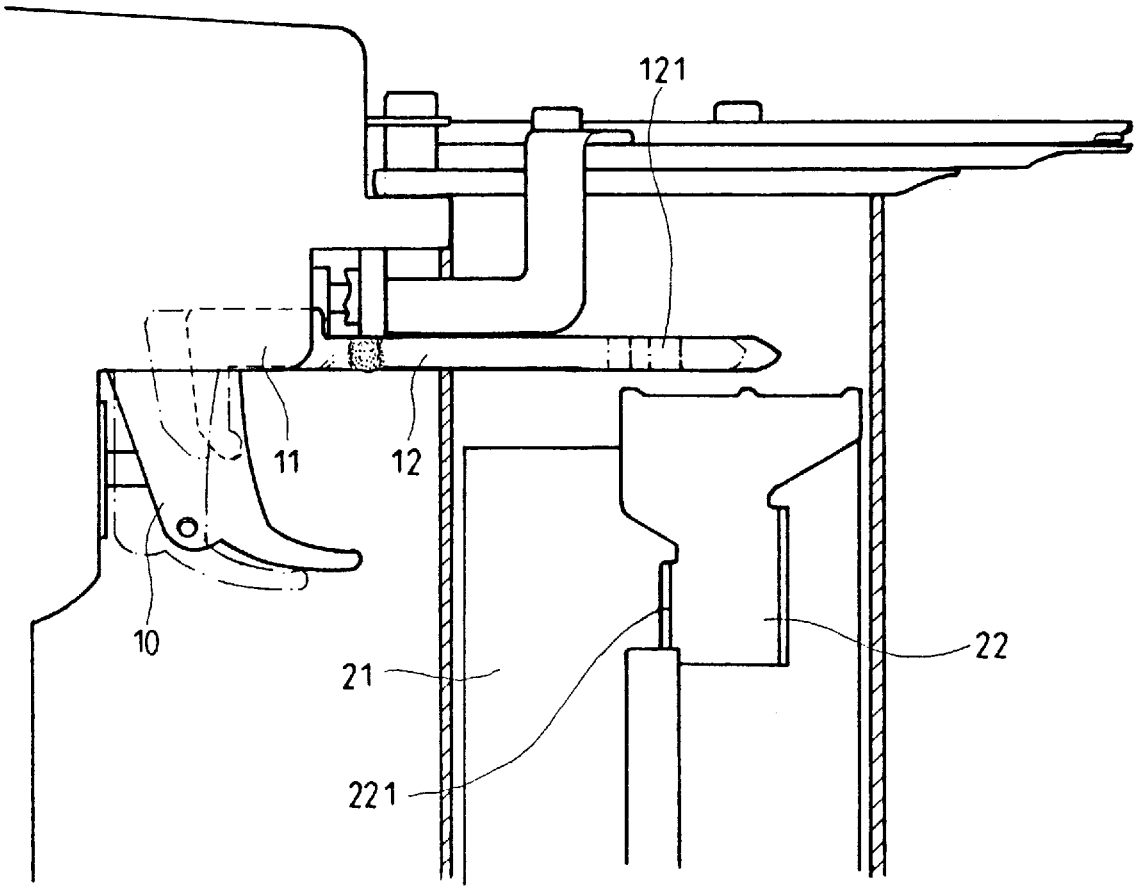
FIG. 1A (PRIOR ART)
FIGS. 1A and 1B are schematic views of the prior art.
Figure 1B:
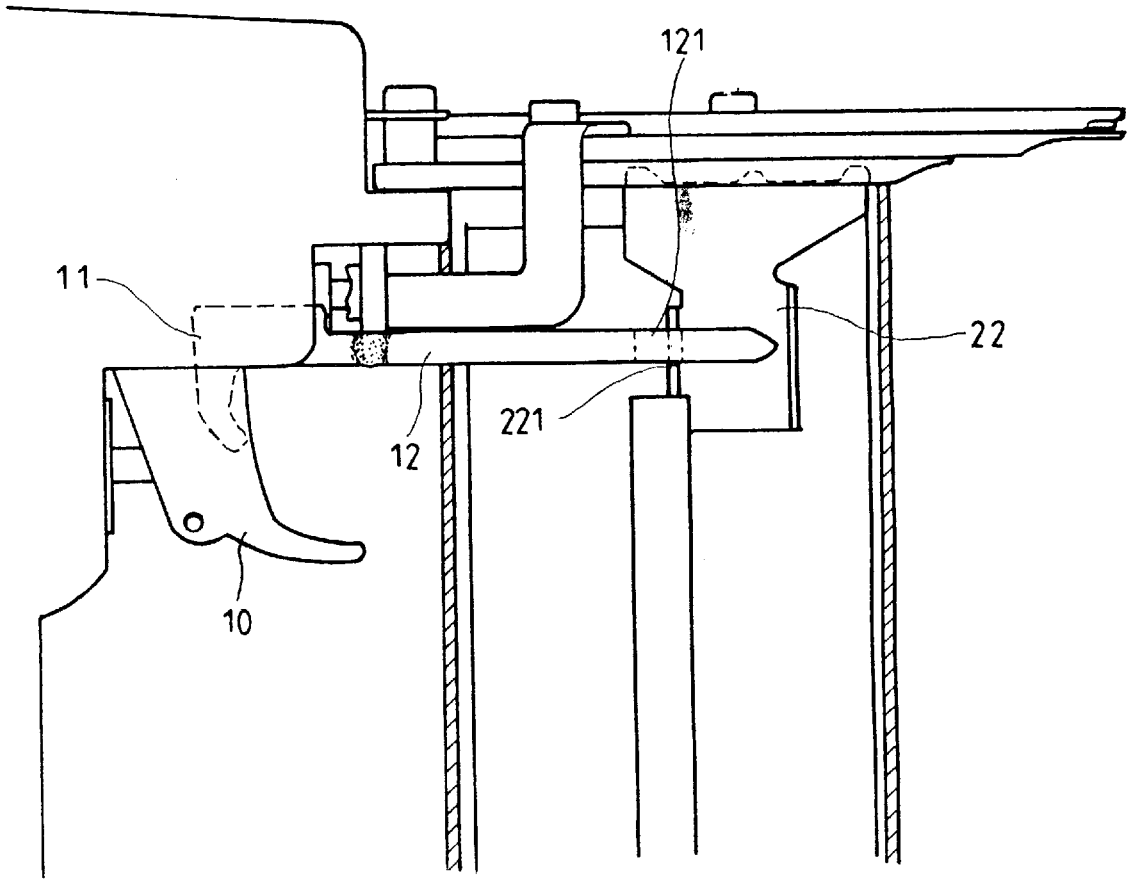
FIG. 1B (PRIOR ART)
Figure 2A:
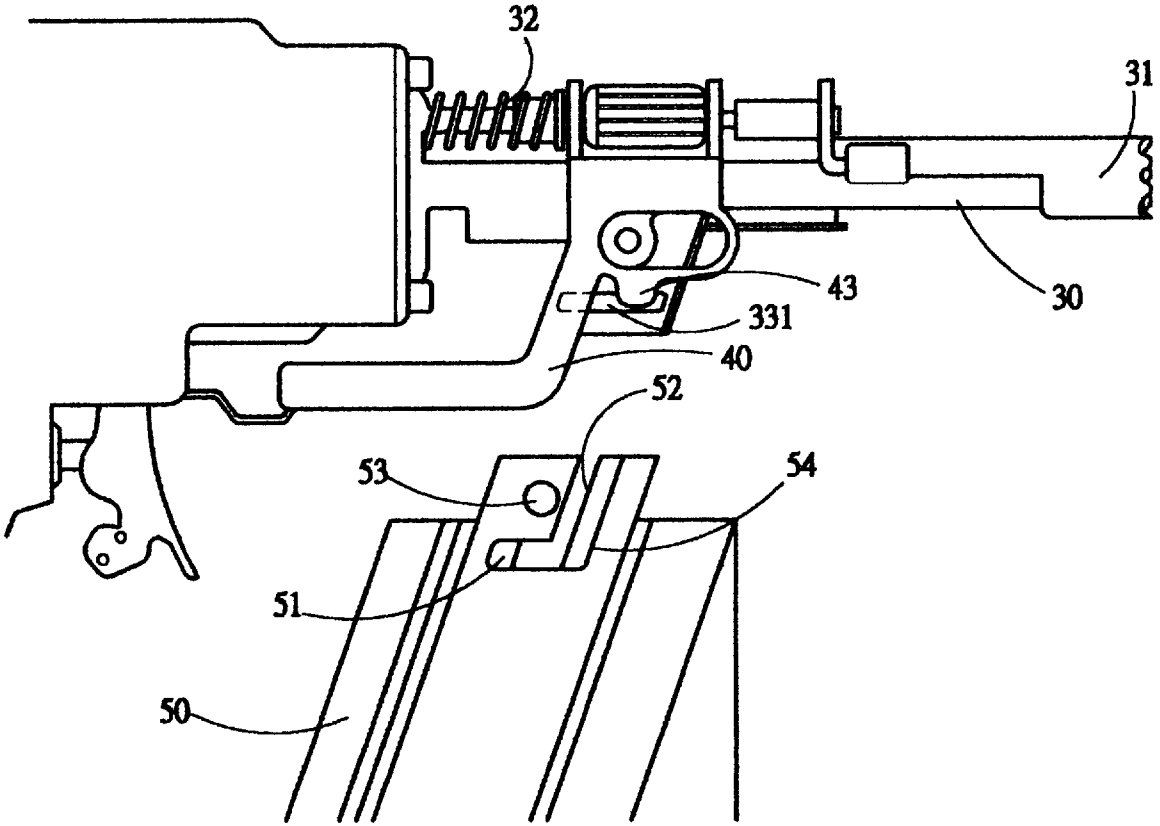
FIGS. 2A, 2B and 2C are schematic views of the present invention.

With reference to FIG. 2A, the present invention essentially comprises a strike assembly 30, a bumper bar 40, a magazine 50, and a follow plate 60.

The strike assembly 30 is pivotally provided at a front end of a gun body and has a push bar 31 fitted thereon for urging against a workpiece. The push bar 31 has the bumper 40 fitted thereon and is urged by a spring 32 at a rear end thereof. A magazine support 33 is disposed below the strike assembly 30 and provided with an elongate hole 331 at the side adjacent to the bumper bar 40 for extension of a hook 43 thereinto.

Figure 2B:
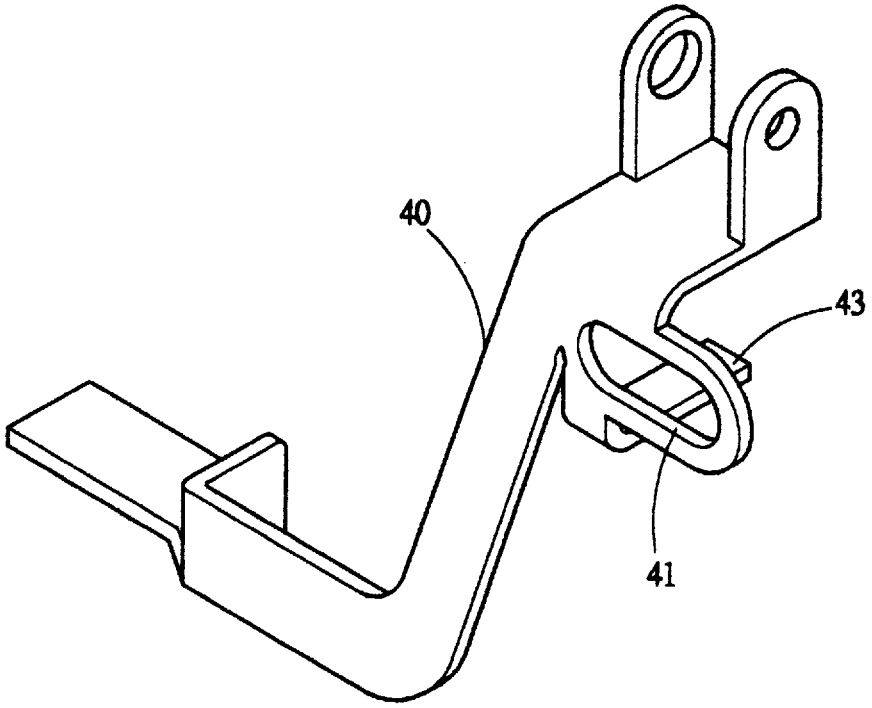

Referring to FIG. 2B, the bumper bar 40 has a rear end extending into the interior of a trigger and a front end bending upwardly to fit onto the push bar 31 so that it may achieve linking-up movement with the push bar 31. The bumper bar 40 is provided with an elongated circular hole 41 for passage of a screw bolt 42 which is locked to the magazine 50 so that it may not interfere with the movement of the bumper bar 40. The hook 43 is integrally formed and extends upwardly from the bumper bar 40. After bending, the hook 43 extends into the elongate hole 331 of the magazine support 33.

The magazine 50 is internally provided with a slide groove 51 whereby the follow plate 60 and a slide element 63 thereof may slide in the magazine 50 for pushing the nails. One side of the slide groove 51 is provided with a slot 52. Screw holes 53 are formed at both sides of a top end of the magazine 50. An L-shaped slot 54 is provided at the side near the bumper bar 40. When the magazine 50 is coupled to the magazine support 33, the hook 43 of the bumper bar 40 may freely move within the L-shaped hole.

Figure 2C:
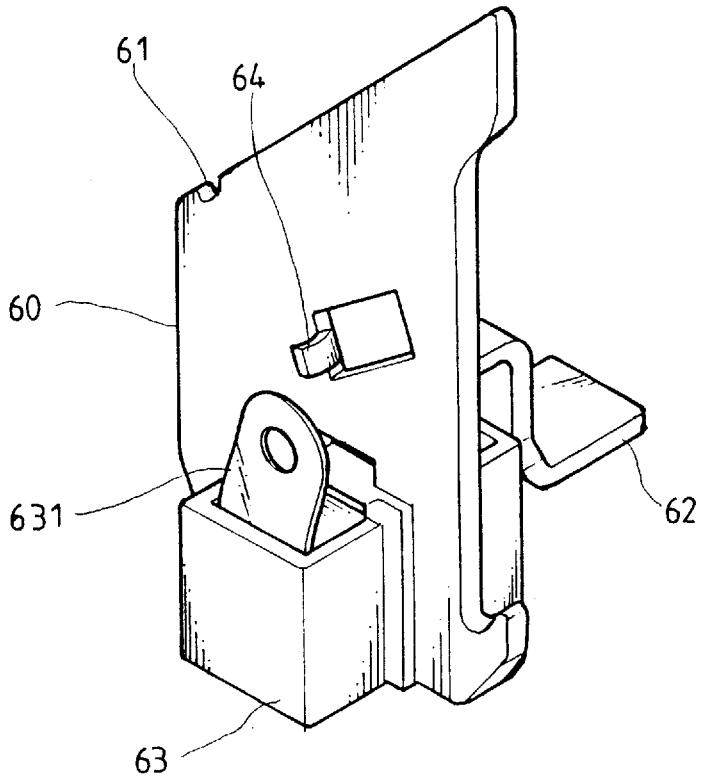

With reference to FIG. 2C, the follow plate 60 is essentially a plate structure. A front end of the follow plate 60 which is in contact with the nails forms an inclined surface with a depression 61 which may precisely guide the heads of the nails. A handle portion 52 is formed at a lateral side thereof for passing through the slot 52 of the magazine 50. On that side of the follow plate 60 which is one the same side of the bumper bar is disposed an integrally formed stop portion 64 which extends outwardly therefrom. The slide element 63 is provided near a rear end of the follow plate 60. A spring 631 is disposed in side the slide element 63 and engages the stop portion 64.

Figure 3A:
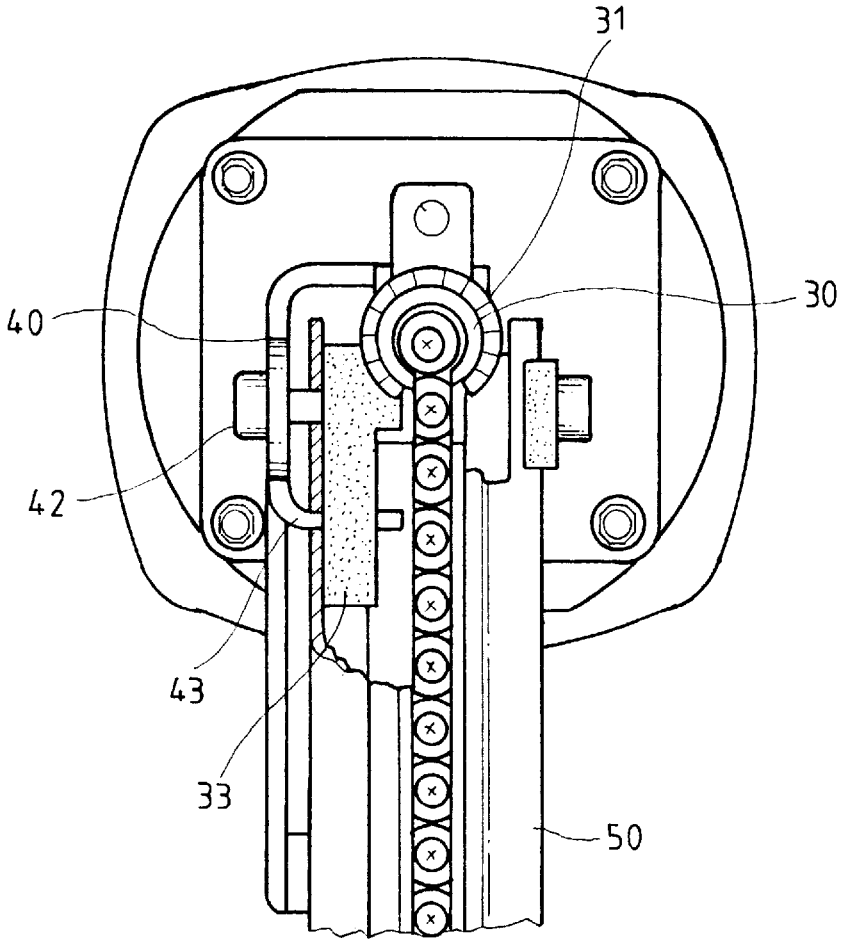
FIGS. 3A and 3B are schematic views illustrating the operation of the present invention.
Figure 3B:
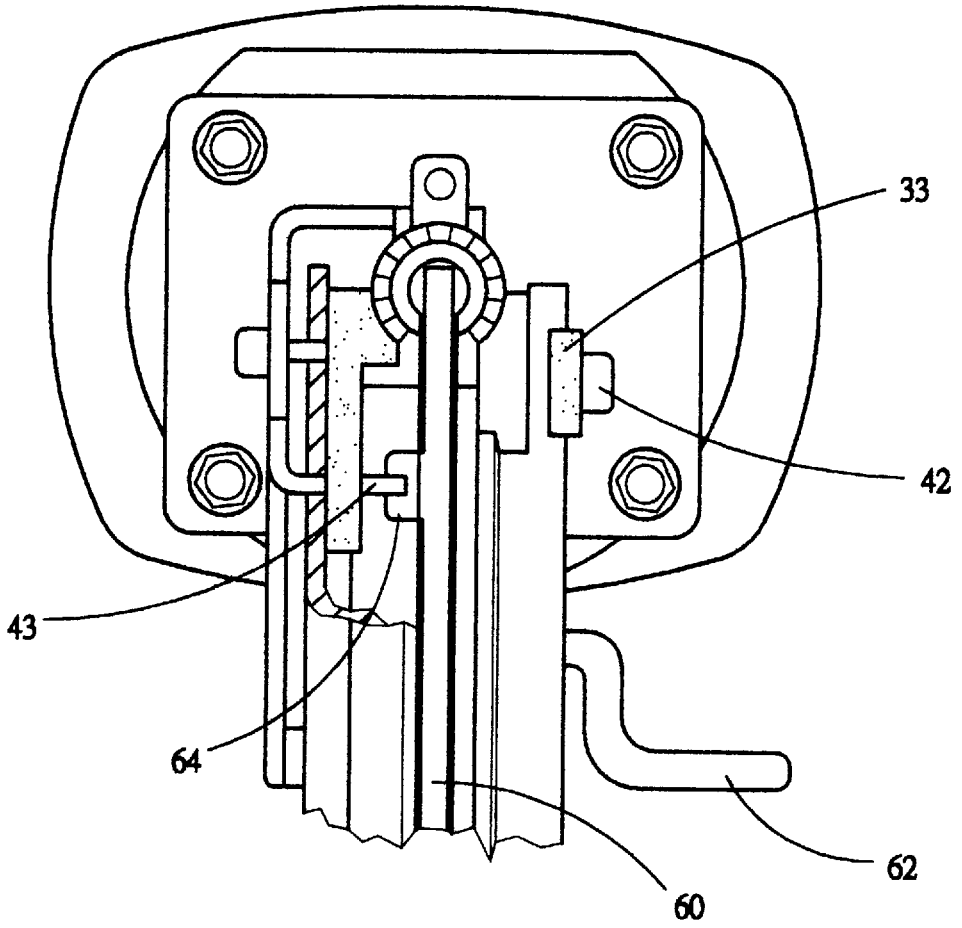

Operation of the present invention will now be described with reference to FIGS. 3A and 3B. If there are still nails in the magazine 50, when the trigger is pulled and the strike assembly 30 is urged against a workpiece, the push bar 31 will link up with the bumper bar 40 and move rearwardly, pressing an internal trigger plate which will then urge open an air valve so that compressed air flow changes in direction to cause a strike plate to strike. If the nails are used up, a front end of the follow plate 60 will urge against the strike assembly 30, and the follow plate 60 will elevate to the position of the magazine support 33. The stop portion 64 will then be behind the hook 43 of the bumper bar 40. At this time, even if the trigger is pulled, and the strike assembly 30 is urged against the workpiece, the hook 43 will be restrained by the stop portion 64 so that it cannot move rearwardly, and consequently, the bumper bar 40 cannot displace rearwardly to touch the internal trigger plate. Therefore, there will be no-idle-striking.

In summary, the present invention provides a structure in which an integrally formed hook is disposed on the bumper bar to directly control the bumper bar, and a stop portion is correspondingly provided on the follow plate so that there is no-idle-striking when there are no more nails in the magazine.

Although the present invention has been illustrated and described with reference to the preferred embodiment thereof, it should be understood that it is in no way limited to the details of such embodiment but is capable of numerous modifications within the scope of the appended claims.

What is claimed is:

1. A no-idle-striking structure for nailing machines, comprising:

a strike assembly with a push bar fitted thereon, said push bar being urged by a spring at a rear end thereof, a magazine support being disposed below said strike assembly;

a bumper bar disposed on said push bar of said strike assembly, said bumper bar having a rear end thereof extending into an interior of a trigger and a front end bending upwardly to fit onto said push bar for linking-up movement therewith;

a magazine, said magazine having a slide groove disposed therein, a slot at a lateral side thereof, and screw holes at both sides of a top end thereof for connection with said magazine support using screw bolts;

a follow plate, said follow plate having an inclined surface at a front end thereof, a handle portion at a lateral side thereof, and a slide element near a rear end thereof, said handle portion passing through said slot of said magazine, said slide element accommodating therein a spring, wherein said magazine support has an elongate hole at one side thereof near said bumper bar;

said bumper bar is provided with an elongated circular hole for passage of screw bolts locking said magazine without interfering with the movement of said bumper bar, and an integrally formed hook that extends upwardly from said bumper bar, bends, and then extends into said elongate hole of said magazine support;

said magazine is provided with an L-shaped hole at the side near said bumper bar, said integrally formed hook of said bumper bar extending into said L-shaped hole and move freely therein after said magazine has been coupled to said magazine support; and said follow plate has a stop portion extending integrally therefrom, said stop portion being located behind said integrally formed hook of said bumper bar to stop any rearward movement of said integrally formed hook when said follow plate elevates as a result of depletion of nails inside said magazine.

* * * * *